United States Patent [19]

Hall

[11] 4,015,780

[45] Apr. 5, 1977

[54] POWDER FORMING

[75] Inventor: Robert Gilmore Hall, Cambridge, England

[73] Assignee: BOC Limited, London, England

[22] Filed: May 5, 1975

[21] Appl. No.: 574,640

[52] U.S. Cl. ..... 241/23; 241/24; 241/DIG. 37

[51] Int. Cl.[2] ..... B02C 23/06

[58] Field of Search ..... 241/17, 18, 20, 23, 241/24, 65, DIG. 37; 29/403

[56] References Cited

UNITED STATES PATENTS

| | | | |
|---|---|---|---|
| 2,288,742 | 7/1942 | Ransohoff | 29/403 |
| 2,942,792 | 6/1960 | Anderson et al. | 241/24 X |
| 3,163,929 | 1/1965 | Goodstein | 29/403 |
| 3,667,691 | 6/1972 | Goldberg | 241/24 |
| 3,718,284 | 2/1973 | Richardson | 241/65 |
| 3,768,739 | 10/1973 | George | 241/65 |
| 3,771,729 | 11/1973 | Frable | 241/65 |
| 3,804,339 | 4/1974 | Laws et al. | 241/DIG. 37 |

*Primary Examiner*—Granville Y. Custer, Jr.
*Attorney, Agent, or Firm*—Dennison, Dennison, Meserole & Pollack

[57] ABSTRACT

A process for producing powdered metal which comprises taking metal swarf, removing oil and grease from the swarf, cooling the swarf to a temperature below −20° C and milling the cooled swarf to form powder.

3 Claims, 3 Drawing Figures

POWDER FORMING

Figure 1:
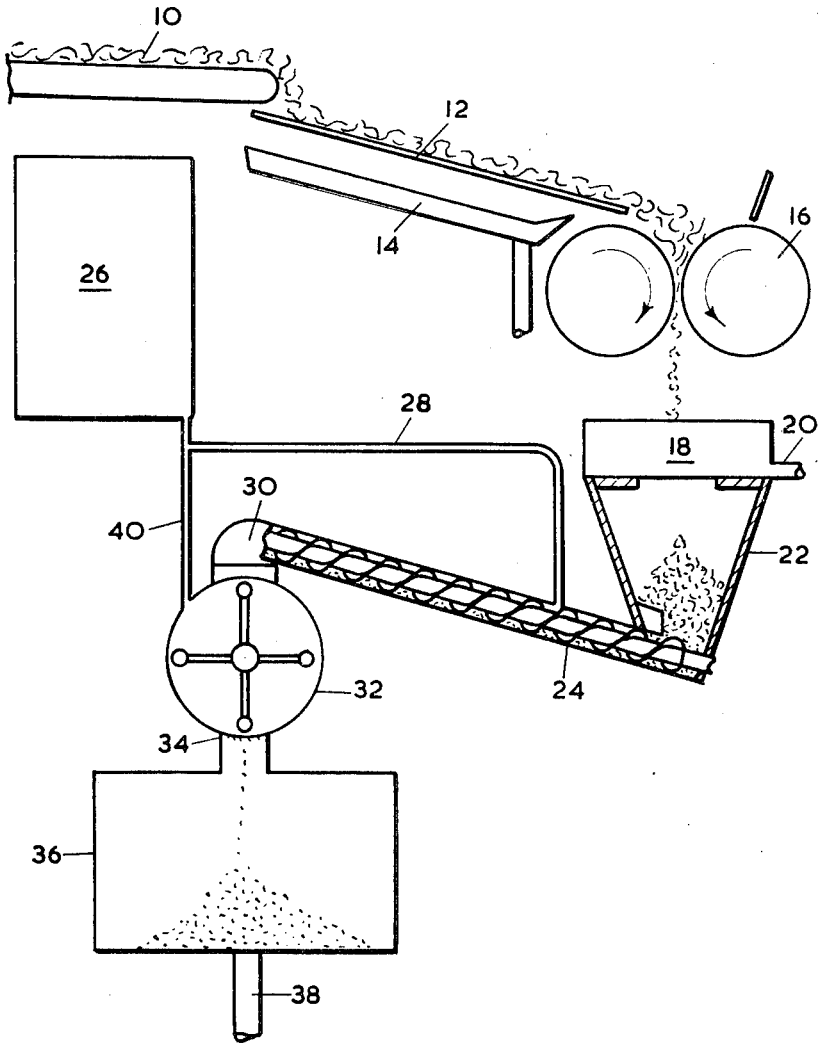

BACKGROUND OF THE INVENTION i. Field of the invention

This invention relates to forming powder from metal swarf.

ii. Description of the Prior Art

If not reclaimed, the metal swarf removed from workpieces during machining operations represents a considerable loss of metal. Thus it is usually collected and sold as scrap, typically in the form of bales. Such scrap is not however in a conveniently reusable form for most purposes, being contaminated with oil, grease and dirt, Proposals have therefore been made to put the swarf into a more convenient form by fragmenting the swarf particles to a maximum particle size of 6 mm and removing oil from the fragments. These fragments can be reduced to powder by milling operations but difficulties arise in the milling as a result of the ductility and hardness of the metal. Moreover the powder is obtained in a fully work-hardened condition and although it can be used for compacting and forging into components the particle size of the powder that is conveniently attainable is too large for conventional powder compaction units. Re-tooling is therefore necessary, but even then the components produced from such particles are of relatively low quality.

THE INVENTION

It is an object of the invention to provide a process for producing from metal swarf a powdered metal of particle size suitable for compaction and forging into top quality components. Such re-use of the metal swarf has the additional advantage of not generating further metal swarf. According to the invention there is provided a process for producing powdered metal which comprises taking metal swarf, removing oil and grease from the swarf, cooling the swarf to a temperature below −20° C and milling the cooled swarf to form powder.

The term "swarf" as used herein includes metal turnings, chippings and the like removed from a workpiece during machining operations.

The process is primarily intended for application to steel swarf but can be applied to other metals, such as copper, used in producing engineering components. The preferred order of procedure is first to remove most, preferably 95%, of the associated oil from the metal swarf, next to reduce the metal swarf to a particle size of about 6 mm diameter, next to remove residual oil and grease from the particles, then to subject the fragments to the cooling step and finally to mill the cooled fragments. The steps can be conducted in a different sequence but this tends to introduce problems into the procedure. For example to cool the swarf prior to cleaning and fragmenting increases the load on the cooling system since it is then required to cool both the metal and the associated oil, and makes for problems in removing the cooled oil from the cooled metal.

The step of reducing the metal swarf to a particle size of 6mm diameter of peferably conducted by crushing the swarf. In some instances the machining operation producing the swarf will produce suitably small fragments for the futher steps. Removal of the major part of the oil and grease from the swarf can be effected by allowing the swarf to stand on a suitable mesh, to encourage the oil to flow off the metal, or by processing in a specially designed centrifuge.

A variety of coolants are available to reduce the temperature of the swarf to the required level. These include solid carbon dioxide, liquid nitrogen, liquid air, liquid argon and liquid natural gas. The cooling can be applied by direct contact with the coolant or indirectly by using the coolant or mechanical refrigeration to cool a liquid bath in which the swarf is immersed. The preferred temperature to which the swarf is cooled varies according to the particular metal involved but is usually in the range −20° to −100° C. Cooling to such levels considerably reduces the impact strength of the material and thus facilitates the subsequent milling.

The milling can be conducted in any convenient form of mill. We have found hammer mills, ball mills or rod mills to be generally the most suitable. Coolant is preferably introduced into the mill during the milling operation so as to maintain the fragments at the desired low temperature.

Direct cooling of the swarf can be effected by passing the swarf, for example by means of a conveyor belt or screw feeder, through a region into which the coolant is introduced. In the case of a liquid coolant such as liquid nitrogen this can be used either as a liquid spray or to provide a bath coolant in the screw feeder through which the metal passes. Alternatively a liquid nitrogen coolant can be used in a conventional tunnel freezer. In whatever system is used with a liquid coolant, means are preferably provided to enable cold to be extracted both from the liquid as such and from the cold vapours leaving the liquid. This is usually best achieved by employing the cold vapours to pre-cool the metal approaching the liquid coolant region.

The powder formed by the milling operation can readily be obtained in the particle size range required for re-using the material in a compacting forging operation. The required particle size is normally in the range −100 to +350 mesh BSS or −40 to +200 mesh BSS.

The invention includes within it scope not only the process for producing the powdered metal but also the powder obtained thereby.

Figure 2:
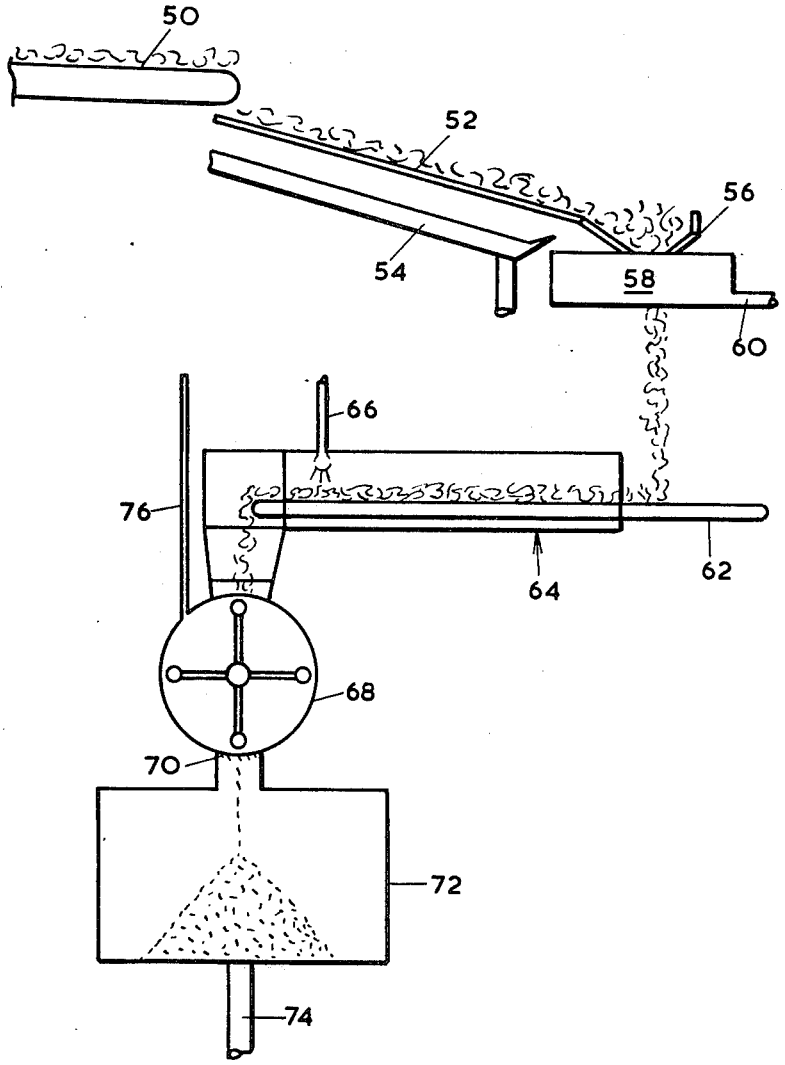

The invention described below with reference to the accompanying figures in which FIG. 1 is a diagrammatic illustration of one form of apparatus for conducting the process according to the invention, FIG. 2 is a diagrammatic illustration of a second form of apparatus conducting a process according to the invention.

Figure 3:
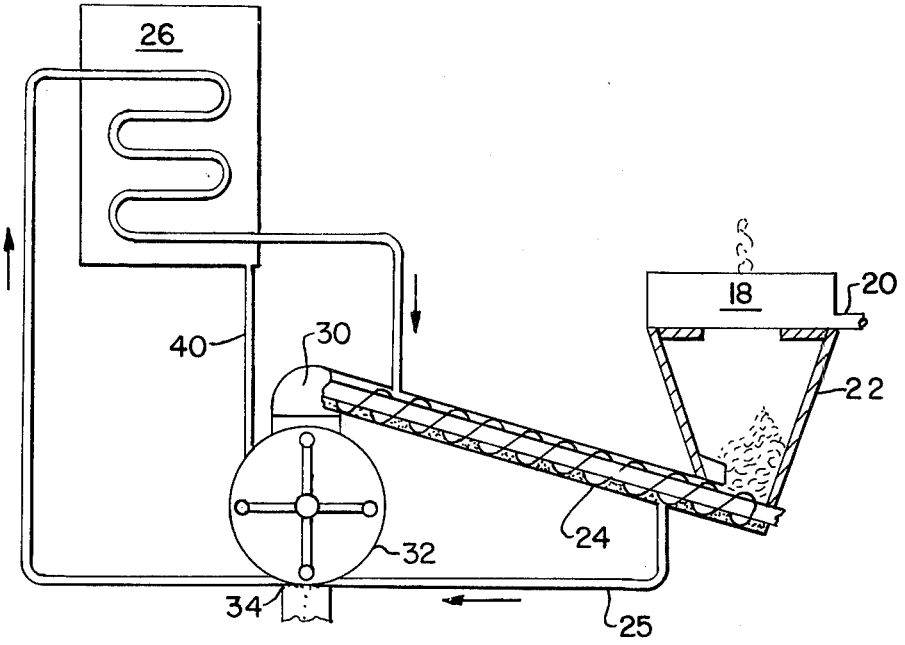

FIG. 3 is a diagrammatic illustration, somewhat similar to that of FIG. 1, showing a portion of the form of the apparatus of the present invention illustrated in FIG. 1 and wherein cooling is effected indirectly.

In the several figures in order to facilitate understanding of the invention various items have been shown on an enlarged scale and several items, for example drive motors, have been omitted.

In the system shown in FIG. 1 metal swarf is carried on an incoming conveyor belt 10 to an inclined vibrating screen 12. The swarf, from which the greater part of associated oil has now been separated is passed into a rotaty crusher 16 from which it emerges as particles having a diameter of approximately 6 mm. These particles with residual oil and grease fall into a centrifuge 18. The residual oil is withdrawn from an outlet 20 and the cleaned swarf fragments fall into a storage hopper 22. The storage hopper 22 leads to an inclined screw conveyor 24 into which liquid nitrogen is conducted from a storage vessel 26 through a conduit 28. The liquid nitrogen thus forms a bath of cold liquid in the lower part of the screw conveyor 24 and the lower part of the hopper 22. Alternatively a spray pipe may be positioned in the hopper and cold vapour passed over the material. Cold nitrogen vapour from the liquid nitrogen passes upwards through the fragments in the hopper 22 to effect a degree of pre-cooling. It is desirable to arrange the rate of feed of fragmented material such that a relatively large quantity of metal fragment is present in the hopper 22 so as to keep to a minimum the quantity of heat passing back along the system to the centrifuge 18. Low temperature operation adversely affects the efficiency of the centrifuge 18.

Cooled metal fragments are conveyed up the inclined conveyor 24 to the inlet 30 of a rotary hammer mill 32. Pulverised metal leaves the hammer mill 32 through a screen 34 in its base and passes into a storage hopper 36 from which it can be withdrawn as required through an outlet conduit 38. Low temperature working conditions in the hamer mill 32 are ensured by the provision of a feed pipe 40 for the introduction of liquid nitrogen directly into the mill 32. Although not so shown in the figure the parts of the apparatus that inlcude liquid nitrogen or cold nitrogen vapours are enclosed within insulating material. This includes items 22, 24, 26, 28, 32, and 40. In the portion of the system shown in FIG. 3 it will be seen that a coolant circulating in a conduit 25 and downwardly through the screw conveyor 24, in the direction of the arrows adjacent to the conduit 25, passes in heat exchange relationship with the cooling medium, i.e., nitrogen, in the storage vessel 26. It will thus be seen that the swarf in the screw conveyor 24 is immersed in the coolant supplied by the conduit 25. Means, not shown, is provided to preclude swarf from entering the conduit 25 with the circulating coolant.

In the system shown in FIG. 2 metal swarf is carried up and incoming conveyor belt 50 to a vibrating inclined screen 52. The swarf, from which most of the oil has been separated, passes via a guide plate 56 into a centrifuge 58 where residual oil and grease is removed, leaving through an outlet 60. The cleaned swarf falls from the centrifuge to the conveyor belt 62 of a freezing tunnel indicated generally by the reference numeral 64. Near the inlet end of the freezing tunnel 64 the swarf is cooled by the cold vapours of liquid nitrogen passing along the tunnel in the opposite direction to that of the swarf. The liquid nitrogen itself is introduced near the swarf outlet end of the tunnel through an inlet header 66 supplied by liquid nitrogen from a storage vessel (not shown). The cooled swarf falls from the end of the conveyor 62 into a rotating hammer mill 68 in which it is pulverised, the powdered material passing through a screen 70 into a storage hopper 72 from which it can be removed as required through an outlet conduit 74. Liquid nitrogen is introduce into the hammer mill via a conduit 76 throughout the milling operation so as to keep the swarf at the desired low temperature.

Because a freezing tunnel system can handle swarf of a wide range of sizes the FIG. 2 system, compared with the FIG. 1 system, can omit the crushing step provided by the rotaty crusher 16. On the other hand the feeding to the hammer mill of a larger size of material to be ground imposes a greater load on the hammer mill 68. In the systems referred in both figures the oil recovered from the collecting trays 14 and 54, and sometimes also from the centrifuges 18 and 58 is sufficiently pure and clean to be reused.

I claim:

1. A process for producing powdered metal which comprises taking metal swarf, substantially removing oil from the swarf, reducing the metal swarf to a particle size of about 6 mm diameter, then substantially removing residual oil and grease from the said particles, cooling the said particles of swarf to a temperature in the range of about minus 20° C to minus 100° C to considerably reduce the impact strength of the swarf particles, and introducing the so cooled swarf particles into a comminuting mill wherein coolant is introduced into the mill during the milling operation so as to maintain the swarf particles at the said temperature range during comminution to a powdered metal having a particle size in the range of about −40 to +350 BSS for producing metal powder suitable for compaction and forging by conventional powder metallurgy techniques.

2. A process as claimed in claim 1, wherein said cooling is by direct contact with a coolant.

3. A process as claimed in claim 1, wherein said cooling is effected indirectly by using a coolant.

* * * * *